United States Patent [19]

Mougin

[11] 4,230,418

[45] Oct. 28, 1980

[54] THERMAL PROTECTIVE DEVICE FOR TABULAR ICEBERGS

[75] Inventor: Georges L. Mougin, Paris, France

[73] Assignee: ITI Limited, Paris, France

[21] Appl. No.: 944,286

[22] Filed: Sep. 21, 1978

[30] Foreign Application Priority Data

Oct. 3, 1977 [FR] France ..... 77 29630

[51] Int. Cl.[2] ..... E02B 1/00

[52] U.S. Cl. ..... 405/52; 405/28; 405/61; 405/211

[58] Field of Search ..... 405/60, 61, 62, 63, 405/64, 52, 53, 211, 217, 66, 67, 26, 28

[56] References Cited

U.S. PATENT DOCUMENTS

| | | | |
|---|---|---|---|
| 3,592,006 | 7/1971 | Crucet | 405/66 |
| 3,852,978 | 12/1974 | Fossberg | 405/67 |
| 4,102,134 | 7/1978 | Margen | 405/53 |

OTHER PUBLICATIONS

*Match,* Oct. 30, 1976.

Ocean Industry of Mar. 1973, pp. 28–29.

*Primary Examiner*—David H. Corbin

*Attorney, Agent, or Firm*—George E. Kersey

[57] ABSTRACT

A device (4) for thermally protecting the side of a tabular iceberg (1) produces a vertical layer of calm water (7) between itself and the vertical side wall of the tabular iceberg. This thermal protective device is suspended from a mechanical protective device, which may comprise a wall of floating towers (5). The protective device comprises panels (8) of woven or non-woven material parallel to the vertical side wall of the tabular iceberg, each of said panels having a width greater than its height, being suspended from a horizontal cable (10) passing through a top hem of the panel and being stretched taut by ballast (9).

8 Claims, 4 Drawing Figures

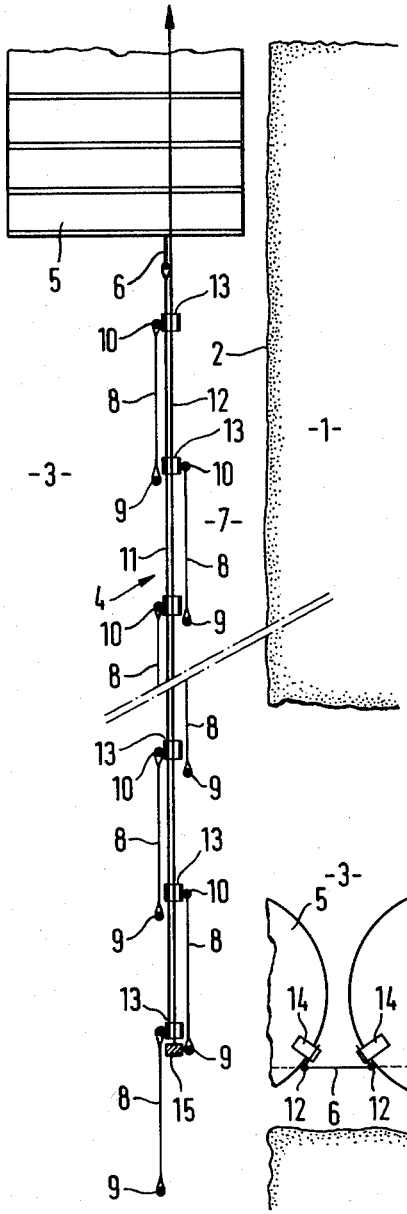
Fig. 1
Fig. 2
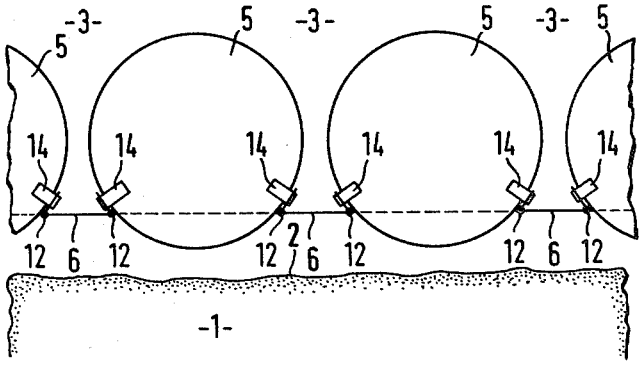

THERMAL PROTECTIVE DEVICE FOR TABULAR ICEBERGS

The present invention relates to large protective devices for tabular icebergs, the function of which is to create a vertical layer of still water along the submerged vertical side faces of the tabular iceberg, this layer of water constituting a good insulator against heat transfer by conduction. Convection is also considerably reduced by virtue of the following factors: height of the layer of water, reduced density of the cold fresh water produced by the melting of the ice which tends to rise like the warm seawater which is therefore cooled by admixture with the cold fresh water.

The possibility of towing tabular icebergs to tropical countries for use as sources of fresh water has often been discussed. The ice packs most suited to this application are those of the south pole. In this region, the ice does not advance in the form of tongues, but forms a plateau with a well-defined frontier where it meets the ocean. The Antarctic continent is not encircled by mountains, but is bordered by a rim of ice, part of which is supported on the continental shelf and the rest of which floats on the surface of the ocean. Under the pressure of the ice inland, this mass of ice is gradually pushed towards the sea. From time to time tabular icebergs become detached from the ice plateau, and may be of very large size, of the order of several square kilometres. It is then possible to tow these tabular icebergs to the dry regions of both hemispheres located close to the coast. Towing the icebergs from the Antarctic to the Northern Hemisphere at a speed of 0.5 m/s takes several months, however, and requires the application of some means of protecting the side surfaces of the tabular iceberg. One proposal in this connection is the manufacture of insulating skirts placed vertically around the tabular iceberg.

U.S. Pat. No. 3,289,415 (Merril), for example, proposes an insulating skirt for an iceberg which comprises an upper inflatable belt, a portion protecting the submerged ice, and ballast weights suspended from the bottom edge of the skirt which is designed to be fastened together at the level of these weights to enclose the fresh water produced by the melting of the tabular iceberg. It should be noted that it is clear from the drawing that the iceberg is not a tabular iceberg, because of the relative dimensions of the skirt, the iceberg and the helicopters. Furthermore, the skirt is made up of vertical strips. It is evident that the problems posed by the passage of a tabular iceberg through warm tropical waters have not been solved, in particular because "thermal" and "mechanical" protection of the tabular iceberg has not yet been suggested.

The present invention is intended to provide a thermal protective device for the side walls of tabular icebergs, to be suspended from a mechanical protective device consisting of floating towers as disclosed in the applicant's French patent application No. FR 77 28859 dated Sept. 26, 1977. Those offshore floating towers comprise cylindrical seawater deflector rings located above a ring of buoyancy tanks enclosing a pneumatic damper bell. The lower end is ballasted. These floating towers have a substantially constant external diameter, and can be used together to form a mechanical protection device for a tabular iceberg. This mechanical protection device is extremely stable, in spite of the movement of the surface of the sea which can have an amplitude of the order of 15 meters, so-called "secular" waves having amplitudes of up to 30 meters. By way of comparison, it should be remembered that the dimensions of the type of tabular iceberg under consideration for towing are of the order of 3500×750 meters. The height of the submerged portion is 6 to 8 times that of the portion above sea level, the total thickness being from 250 to 300 meters.

To describe the present invention in more detail, a thermal protective device for the sides of a tabular iceberg may be suspended from a mechanical protective device, and because it is submerged underneath the mechanical protective device, it is possible to use a relatively lightweight construction. It is, moreover, desirable for the thermal protective device to extend beneath the substantially horizontal bottom surface of the tabular iceberg.

The present invention provides a protective device for thermally protecting the side of a tabular iceberg floating in warm sea by producing a vertical layer of calm water between the protective device and the vertical side wall of the protected tabular iceberg, wherein the thermal protective device is suspended from a mechanical protective device floating in the warm seawater independently of the protected tabular iceberg.

The thermal protective device comprises coated or uncoated panels of woven or non-woven material, parallel to the vertical side wall of the tabular iceberg, each of said panels having a width greater than its height, being suspended from horizontal cables passing through a top hem of the panel and being stretched taut by a horizontal cable passing through a bottom hem. The horizontal cables passing through the top hems of the panels are fastened to runners threaded onto a suspension cable and a lifting cable. The runners are attached to the suspension cables at intervals slightly less than the height of the panels. The suspension cables are hung from a horizontal cable running under the mechanical protective device and parallel to the vertical side wall of the tabular iceberg, between the longitudinal and vertical plane of symmetry of the mechanical protection device and said vertical side wall of the tabular iceberg. The lifting cables are stretched between a winch on the upper portion of the mechanical protective device and a ballast with dimensions greater than the internal diameter of the runners. Successive panels are arranged on alternate sides of the vertical plane defined by the suspension cables. The protective device extends beneath the substantially horizontal lower surface of the tabular iceberg.

The invention will now be described in more detail by way of example only.

In the accompanying drawings, which are given by way of non-limiting example only:

FIG. 1 is a partial cross-section through a protective device in accordance with the invention arranged alongside a tabular iceberg;

FIG. 2 is a plan view corresponding to FIG. 1;

Figure 3:
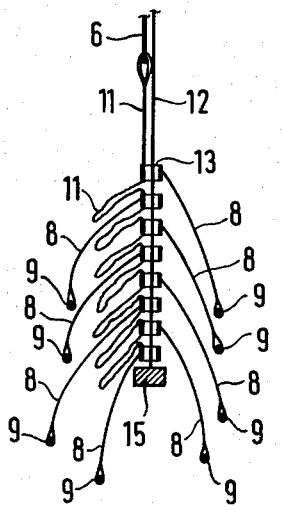
FIG. 3 is a partial cross-section through a protective device in accordance with the invention in the raised position.

A list of the reference numerals used in the following description, with the associated items, will be found after the description.

FIG. 1 shows the submerged portion of a tabular iceberg (1) whose vertical side face (2) is protected from the warm seawater (3) by a protective device (4) suspended from a floating tower (5) by means of a horizontal cable (6). Between the protective device (4) and the vertical side wall (2) of the tabular iceberg (1) is a vertical layer of cold water (7) providing thermal insulation against convection and conduction.

Figure 4:
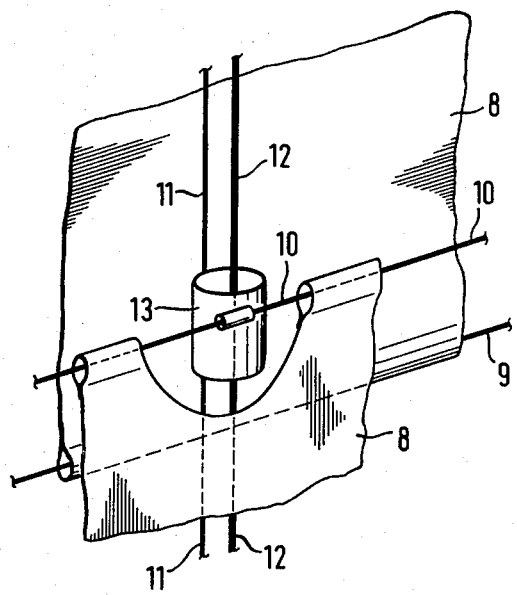
FIG. 4 is a partial perspective view of a protective device in accordance with the invention, showing one of the runners.

The protective device (4) comprises panels (8) of coated or uncoated woven or non-woven material, 100 to 200 meters long and approximately 10 meters high. Each of the panels (8) is ballasted by means of a horizontal cable (9) passing through the lower hems of the panels (8). Said panels (8) are suspended from a horizontal cable (10) passing through the upper hems of the panels (8). The horizontal cable (10) is fastened to runners (13) threaded onto a suspension cable (11) and a lifting cable (12) (refer to FIG. 4). The runners (13) are attached to the suspension cables (11) at intervals slightly less than the height of the panels (8). The lifting cables (12) may be wound around winches (14) located above the surface of the sea (3) on the superstructures of the floating towers (5), as can be seen in FIG. 3. To the lower ends of the lifting cables (12) are attached ballast weights (15) which, because they are larger than the internal diameter of the runners (13), enable the protective device to be partially or totally raised by winding the lifting cables (12) around the winches (14).

When the protective device (4) is raised by winding the lifting cables (12) around the winches (14), the ballast weights (15) raise the runners (13) one after the other. Thus no tension is applied to the suspension cables (11). When completely raised, the protective device (4) adopts the shape of a skein, as shown in FIG. 3.

Successive panels (8) are arranged on alternate sides of the imaginary vertical plane formed by the lifting cables (13), to permit, where necessary, minimal circulation of the seawater (3) and the vertical layer of cold water (7). This circulation equalizes the pressures when the protective device is in position in front of the vertical side wall (2) of a tabular iceberg (1). When being used on an industrial basis, the tabular iceberg (1) slowly melts, because of the removal of melted ice from the surface and because of the natural melting which the thermal protective device (4) and the mechanical protective device formed by the floating towers (5) can only slow down. The draught of the iceberg decreases, and it is possible to partially raise the protective device (4), for example to avoid it being deteriorated when the tabular iceberg (1) is beached.

It is possible to form a number of parallel layers of cold water (7) by increasing the number of curtains of panels (8), suspended as described above from horizontal cables (6) running beneath the mechanical protective device and parallel to the vertical side wall (2) of the tabular iceberg (1).

LIST OF REFERENCE NUMERALS 1 tabular iceberg
2 vertical side wall of a tabular iceberg (1)
3 warm seawater
4 protective device
5 floating tower
6 horizontal cable
7 vertical layer of cold water
8 panel
9 ballast for panels (8)
10 horizontal cable
11 suspension cable
12 lifting cable
13 runners
14 winches
15 ballast for lifting cables (12)

I claim:

1. A protective device for thermally protecting the side of an iceberg floating in warm sea by producing a vertical layer of calm water between the protective device and the side wall of the protected iceberg, wherein a thermal protective device is suspended from a mechanical protective device floating in the warm seawater independently of the protected iceberg, and the thermal protective device comprises panels of material disposed at the side of the iceberg, each of said panels having a width greater than its height, being suspended from horizontal cables passing through a top hem of the panel and being stretched taut by a horizontal cable passing through a bottom hem of the panel, said horizontal cable being fastened to runners threaded onto a suspension cable and a lifting cable.

2. A protective device according to claim 1, wherein the runners are attached to the suspension cables at intervals slightly less than the height of the panels.

3. A protective device according to claim 2, wherein the suspension cables are hung from a horizontal cable running under the mechanical protective device and parallel to the vertical side wall of the tabular iceberg, between the longitudinal and vertical plane of symmetry of the mechanical protection device and said vertical side wall of the tabular iceberg.

4. A protective device according to claim 1, wherein the lifting cables are stretched between a winch on the upper portion of the mechanical protective device and a ballast with dimensions greater than the internal diameter of the runners.

5. A protective device according to claim 1, wherein it extends beneath the substantially horizontal lower surface of a tabular iceberg.

6. A protective device according to claim 1, wherein successive panels are arranged on alternate sides of the vertical plane defined by the suspension cables.

7. A protective device according to claim 1 wherein said panels are coated.

8. A protective device according to claim 1 wherein the panels are of woven material.

* * * * *